US011247751B2

(12) United States Patent
Huang et al.

(10) Patent No.: US 11,247,751 B2
(45) Date of Patent: Feb. 15, 2022

(54) INFLATABLE BOAT

(71) Applicant: BESTWAY INFLATABLES & MATERIAL CORP., Shanghai (CN)

(72) Inventors: Shuiyong Huang, Shanghai (CN); Hongxing Zhang, Shanghai (CN); Yanxing Zhang, Shanghai (CN); Xingdi Wu, Shanghai (CN)

(73) Assignee: BESTWAY INFLATABLES MATERIAL CORP., Shanghai (CN)

( * ) Notice: Subject to any disclaimer, the term of this patent is extended or adjusted under 35 U.S.C. 154(b) by 2 days.

(21) Appl. No.: 16/854,902

(22) Filed: Apr. 22, 2020

(65) Prior Publication Data

US 2020/0369344 A1 Nov. 26, 2020

(30) Foreign Application Priority Data

May 22, 2019 (CN) ..... 201920739252.4

(51) Int. Cl.
*B63B 7/08* (2020.01)
*B63B 29/04* (2006.01)

(52) U.S. Cl.
CPC ..... *B63B 7/085* (2013.01); *B63B 29/04* (2013.01); *B63B 2029/043* (2013.01)

(58) Field of Classification Search
CPC .... B63B 7/085; B63B 29/04; B63B 2029/043
See application file for complete search history.

(56) References Cited

U.S. PATENT DOCUMENTS 5,070,807 A * 12/1991 Lewis ..... B63B 17/02 114/361
2020/0369344 A1* 11/2020 Huang ..... B63H 16/10

FOREIGN PATENT DOCUMENTS

DE 3910442 11/1989
DE 3910442 A1 * 11/1989 ..... B63B 35/38
EP 2674071 12/2013
EP 2674071 A1 * 12/2013 ..... B29C 66/1122
EP 3741659 A1 * 11/2020 ..... B63H 16/10

OTHER PUBLICATIONS

Extended European Search Report dated Oct. 13, 2020 (Oct. 13, 2020) issued on related European patent application 20170610.8 by the European Patent Office.

* cited by examiner

*Primary Examiner* — S. Joseph Morano
*Assistant Examiner* — Jovon E Hayes
(74) *Attorney, Agent, or Firm* — Dickinson Wright PLLC

(57) ABSTRACT

An inflatable boat comprises a body and a tube. The tube is located adjacent to the body. A tensioning member is located between the body and the tube. The tensioning member couples the body to the tube such that a top surface of the body and a top surface of the tube are coplanar. The body can define at least one footrest groove to allow a user to lean and rest their feet on the body.

17 Claims, 2 Drawing Sheets

INFLATABLE BOAT

CROSS-REFERENCE TO RELATED APPLICATION

The present application claims priority to Chinese Patent Application Ser. No. CN201920739252.4, filed on May 22, 2019, the entire disclosure of which is hereby incorporated herein by reference.

TECHNICAL FIELD

The present invention relates generally to an inflatable body and, in particular, an inflatable boat.

BACKGROUND

Inflatable boats are widely used in tourism, rafting, sports competitions, military surveys and exploration, fishing, hunting and other occasions. The inflatable boat can also be used for various water engineering operations, flood control, emergency response, sea rescue, etc. Typically, an inflatable boat generally comprises a tube and a body to form a cabin. The tube and the body are respectively provided with a gas valve that enables inflation and deflation of the inflatable boat. When the inflation is completed, the buoyancy of the tube and the body causes the inflatable boat to float or sail on the water.

The tube and the body of a conventional inflatable boat are not coplanar to one another such that, when in use, the body can sink easily, while the tube floats. This creates great inconvenience for the user and also presents potential safety hazards when boating. In addition, conventional inflatable boats do not include separate footrests, thereby failing to accommodate users of different heights.

SUMMARY OF THE INVENTION

The present invention aims to solve at least the above problems of the prior art by, among other things, providing an inflatable boat wherein a top surface of a tube and a top surface of a body are coplanar, thereby avoiding sinking of the inflatable boat during use. The present invention also provides an inflatable boat including at least one set of footrest grooves for accommodating users of different heights and/or physiques, thereby allowing different people to use the inflatable boat.

It is an aspect of the present invention to provide an inflatable boat. The inflatable boat comprises a body, a tube, and a tensioning member. The tensioning member is located between the body and the tube. The tube is located adjacent to the body. The tensioning member couples the body to the tube to establish a coplanar relationship between a top surface of the body and a top surface of the tube.

According to an embodiment of the present invention, the tube and the tensioning member can extend annularly about the body.

According to an embodiment of the present invention, the body and the tube can be inflatable. The body can define a boat body chamber. The tube can define a boat tube chamber, The boat body chamber and the boat tube chamber are separated by the tensioning member.

According to an embodiment of the present invention, there may be no fluid communication between the boat body chamber and the boat tube chamber.

According to an embodiment of the present invention, the body can include a top sheet, a bottom sheet, and a plurality of tensioning strips. The plurality of tensioning strips can extend between the top sheet and the bottom sheet to couple the top sheet to the bottom sheet.

According to an embodiment of the present invention, the plurality of tensioning strips can includes a plurality of first tensioning strips. The plurality of first tensioning strips can include a first set of first tensioning strips and a second set of first tensioning strips. The first set of first tensioning strips can be located adjacent to a bow of the inflatable boat. The second set of first tensioning strips can be located adjacent to a stern of the inflatable boat.

According to an embodiment of the present invention, the plurality of tensioning strips can include a plurality of second tensioning strips located between the first set of first tensioning strips and the second set of first tensioning strips.

According to an embodiment of the present invention, the plurality of first tensioning strips can extend in a lengthwise direction within the body and the plurality of second tensioning strips can extend in a widthwise direction within the body.

According to an embodiment of the present invention, the body can define at least one footrest groove to allow a user to lean and rest their feet on the body.

According to an embodiment of the present invention, the plurality of tensioning strips can include a plurality of third tensioning strips located between the first set of first tensioning strips and the plurality of second tensioning strips. The plurality of third tensioning strips can extend between the top sheet and the bottom sheet to define the at least one footrest groove.

According to an embodiment of the present invention, the body can define a backrest groove spaced apart from the at least one footrest groove and extending along the inflatable boat in a widthwise direction.

According to an embodiment of the present invention, the plurality of tensioning strips can include a plurality of fourth tensioning strips located between the second set of first tensioning strips and the plurality of second tensioning strips. The plurality of fourth tensioning strips can extend between the top sheet and the bottom sheet to define the backrest groove.

According to an embodiment of the present invention, the inflatable boat can further include a backrest located in the backrest groove. The backrest can extend outwardly from the backrest groove to provide support to the user.

According to an embodiment of the present invention, the backrest can be detachably coupled to the body.

According to an embodiment of the present invention, the backrest can be fixedly coupled to the body via welding, melting, or bonding.

According to an embodiment of the present invention, the backrest can comprise an inflatable backrest and includes a first backrest sheet, a second backrest sheet, and a surrounding sheet. The surrounding sheet can couple the first backrest sheet to the second backrest sheet to define a backrest chamber. The backrest may further include a plurality of backrest tensioning strips, spaced apart from one another and extending between the first backrest sheet and the second backrest sheet.

According to an embodiment of the present invention, the inflatable boat can further include at least one of a fixing rope, a handle, a paddle ring, and a paddle stand located on the body and/or the tube.

According to an embodiment of the present invention, the inflatable boat can further include at least one spoiler located on a bottom surface of the body and extending outwardly from the bottom surface.

BRIEF DESCRIPTION OF THE DRAWINGS

Other features and advantages of the present invention will be better understood through the following embodiments described in detail with reference to the accompanying drawings. In the drawings, the same reference numerals identify the same or similar parts, in which.

DETAILED DESCRIPTION OF THE INVENTION

The implementation and application of the embodiments will be discussed in detail below. However, it should be understood that the specific embodiments discussed only illustratively describe the various implementation and use of the present invention, and are not intended to limit the scope of the present invention. In the description, the structural positions of various components, e.g., upper, lower, top, bottom, etc., are not absolute, but relative. The orientation expressions are appropriate when the various components are arranged, as shown in the figures, but should change accordingly when the positions of the various components in the figures change.

As used herein, the term "inner" refers to a direction toward an inflatable region of an inflatable chamber, and the term "outer" refers to a direction away from the inflatable region; the term "fluid" refers to a filling gas, such as air; and the term "top surface" refers to a surface of an inflatable boat for the user to step on and sit on, and the term "bottom surface" refers to a surface of the inflatable boat that is usually placed on water.

Figure 1:
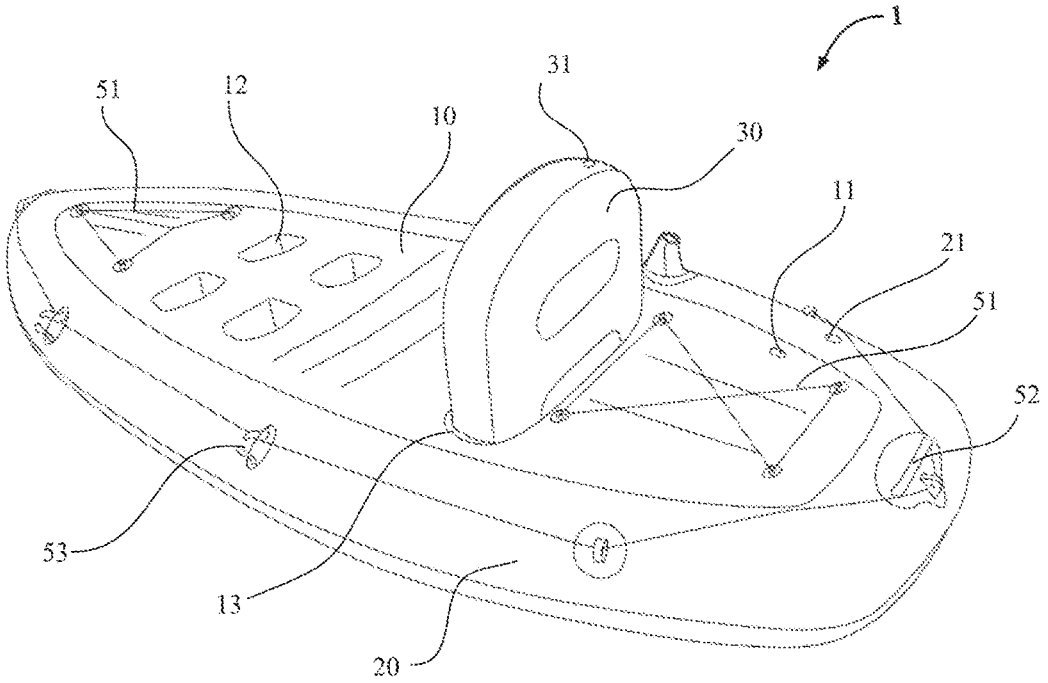
FIG. 1 is a perspective view of an inflatable boat constructed in accordance with an embodiment of the present invention.
Figure 2:
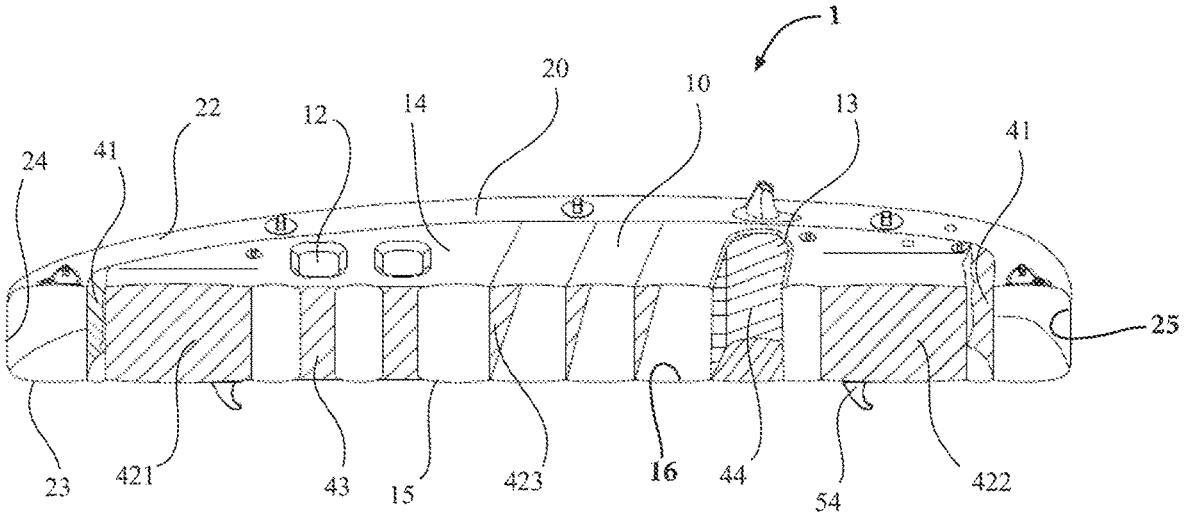
FIG. 2 is a cross-sectional view of the inflatable boat.

As best shown in FIGS. 1 and 2, an inflatable boat 1 constructed according to an embodiment of the present invention comprises a body 10 and a tube 20. The tube 20 is located adjacent to the body 10. According to an embodiment of the present invention, the body 10 can be provided with a backrest 30 and at least one footrest groove 12 for providing support to a user. A tensioning member 41 is located between the body 10 and the tube 20. The tensioning member 41 couples the body 10 to the tube 20 such that a top surface of the body 10 and a top surface of the tube 20 are coplanar with one another. According to an embodiment of the present invention, the tube 20 and the tensioning member 41 extend annularly about the body 10. In other words, the tensioning member 41 is arranged in a surrounding manner between the body 10 and the tube 20 to couple the body 10 and the tube 20 such that the top surface of the body 10 and the top surface of the tube 20 are in a coplanar relationship with one another. This arrangement allows the user to easily step onto the body 10 and remain on the inflatable boat 10, thereby providing a safe, reliable, and comfortable inflatable boat 1 for the user. In addition, this arrangement avoids having water being trapped between the body 10 and the tube 20, thereby preventing the inflatable boat 1 from sinking during use. It should be understood that the tensioning member 41 can be coupled to the body 10 and the tube 20 via many methods, such as but not limited to high frequency welding, hot melting connection, adhesion, and other mechanical connections well known to those skilled in the art.

According to an embodiment of the present invention and as best illustrated in FIG. 2, the body 10 and the tube 20 are inflatable. The body 10 comprises a top sheet 14 forming the top surface of the body 10, a bottom sheet 15 forming a bottom surface of the body 10, and a plurality tensioning strips extending between the top sheet 14 and the bottom sheet 15 to couple the top sheet 14 with the bottom sheet 15. The tube 20 comprises a boat tube top sheet 22, forming a top surface of the tube 20, a boat tube bottom sheet 23, forming a bottom surface of the tube 20, and an annular surrounding sheet 24, coupling to the boat tube top sheet 22 and the boat tube bottom sheet 23. The tensioning member 41 couples to the top sheet 14 and the bottom sheet 15 of the body 10 to define a boat body chamber 16 that can be inflated or deflated via a boat body gas valve 11. The tensioning member 41 couples to the boat tube top sheet 22, the boat tube bottom sheet 23, and the annular surrounding sheet 24 of the tube 20 to define a boat tube chamber 25 that can be inflated or deflated via a boat tube gas valve 21. In this arrangement, there is no fluid communication between the boat body chamber 16 and the boat tube chamber 25. To facilitate inflation and deflation, the boat body gas valve 11 can be coupled on the top sheet 14, and the boat tube gas valve 21 can be mounted on the boat tube top sheet 22 to prevent users from making contact with the gas valves 11, 21 during their activities, thus avoiding damage to gas valves 11, 21. It should be understood that the position of the gas valves 11, 21 should enable the inflation and deflation of the boat body chamber 16 and the boat tube chamber 25. According to an embodiment of the present invention, the gas valve 11 may be mounted to the bottom sheet 15 or the annular surrounding sheet 24. It should be appreciated that each of the gas valves 11, 21 can also comprise an integrated charging and discharging high-pressure gas valve. A user can inflate or deflate/discharge gas from the body 10 and the tube 20 via a gas pump device, such as an external hand pump. This way, gas in the inflatable boat 1 and the backrest 30 can be discharged when not in use, and the inflatable boat 1 can be folded for storage and transportation.

The plurality of tensioning strips includes a plurality of first tensioning strips 421, 422 and a plurality of second tensioning strips 423. According to an embodiment of the present invention, the plurality of first tensioning strips 421, 422 includes a first set of first tensioning strips 421 and a second set of first tensioning strips 422. The first set of first tensioning strips 421 is located adjacent to a bow of the inflatable boat 1. The second set of first tensioning strips 422 is located adjacent to a stern of the inflatable boat 1. The plurality of second tensioning strips 423 is located between the first set of first tensioning strips 421 and the second set of first tensioning strips 422 for providing support to the user. In other words, the plurality of second tensioning strips 423 are arranged in the middle of the body 10 and spaced apart from each other. According to an embodiment of the present invention, the plurality of first tensioning strips 421 extends in a lengthwise direction within the body 10 and the plurality of second tensioning strips 423 extends in a widthwise direction within said body 10.

As best illustrated in FIG. 2, upper edges of the plurality of first tensioning strips 421, 422 and upper edges of the plurality of second tensioning strips 423 are connected to an inner surface of the top sheet 14. Lower edges of the plurality of first tensioning strips 421, 422 and lower edges of the plurality of second tensioning strips 423 are connected to an inner surface of the bottom sheet 15. After the boat body chamber 16 is inflated, the plurality of first tensioning strips 421, 422 and the plurality of second tensioning strips 423 help to maintain the body 10 in a predetermined shape. The plurality of first tensioning strips 421, 422 and the plurality of second tensioning strips 423 also help to prevent the body 10 from deforming. Additionally, the first set of first tensioning strips 421 provide support to the bow of the inflatable boat 1. The second set of first tensioning strips 422 provide support to the stern of the inflatable boat 1. Furthermore, the plurality of second tensioning strips 423 provide support to the middle portion of the body 10 such that inflatable boat 1 is firm in structure, durable and shock-resistant, thereby ensuring user's safety.

According to an embodiment of the present invention, the body 10 defines at least one footrest groove 12 to allow a user to lean and rest their feet on the body 10. By providing at least one footrest groove 12 and the backrest 30, the user can comfortably sit on the inflatable boat 1 and conveniently apply force to paddle the inflatable boat 1. According to an embodiment of the present invention, the at least one footrest groove 12 and the backrest 30 may be provided on the top sheet 14 of the body 10. It should be appreciated that the at least one footrest groove 12 and the backrest 30 may be provided as separate components coupled to the top sheet 14 of the body 10 via welding or bonding. It should also be appreciated that the at least one footrest groove 12 and the backrest 30 can be detachably coupled to the top sheet 14 of the body 10 via a buckle connection.

According to an embodiment of the present invention, the top sheet 14 of the body 10 defines at least one footrest groove 12. The plurality of tensioning strips includes a plurality of third tensioning strips 43 located between the first set of first tensioning strips 421 and the plurality of second tensioning strips 423. The plurality of third tensioning strips 43 extends between the top sheet 14 and the bottom sheet 15 of the body 10 to define the at least one footrest groove 12. In other words, the at least one footrest groove 12 is defined by the plurality of third tensioning strips 43. According to an embodiment of the present invention, the body 10 may include a pair of footrest grooves 12 arranged symmetrically at intervals in the lengthwise and/or widthwise direction of the body 10 to facilitate users of different heights or physiques. For example, according to an embodiment of the present invention, the footrest grooves 12 are arranged symmetrically at intervals in the lengthwise direction of the body 10, wherein each footrest groove 12 of a pair of footrest grooves 12 extends in the widthwise direction of the body 10 for receiving the user's legs such that the two pairs of footrest grooves 12 can be appropriately selected to match users of different heights. Alternatively, the pair of footrest grooves 12 can be arranged symmetrically at intervals in the widthwise direction of the body 10, wherein each footrest groove 12 of the pair of footrest grooves 12 may extend in the lengthwise direction of the body 10 for users to adjust the position of their feet in the lengthwise direction of the inflatable boat 1. According to an embodiment of the present invention, a plurality of four footrest grooves 12 are formed symmetrically in the lengthwise direction and the widthwise direction of the body 10. Each footrest groove 12 of the plurality of footrest grooves 12 is defined by the plurality of third tensioning strips 43 extending between the top sheet 14 and the bottom sheet 15 of the body 10.

Figure 3:
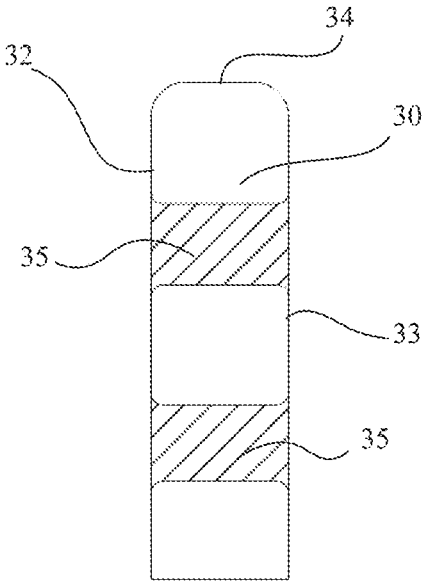
FIG. 3 is a cross-sectional view of a backrest for the inflatable boat constructed in accordance with an embodiment of the present invention.
Figure 4:
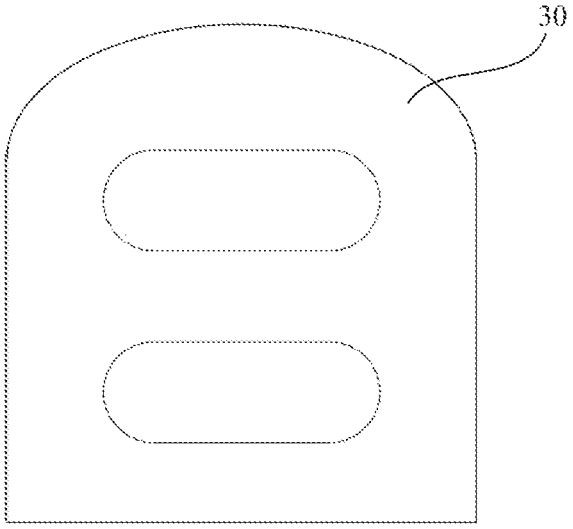
FIG. 4 is a front view of the backrest.
Figure 5:
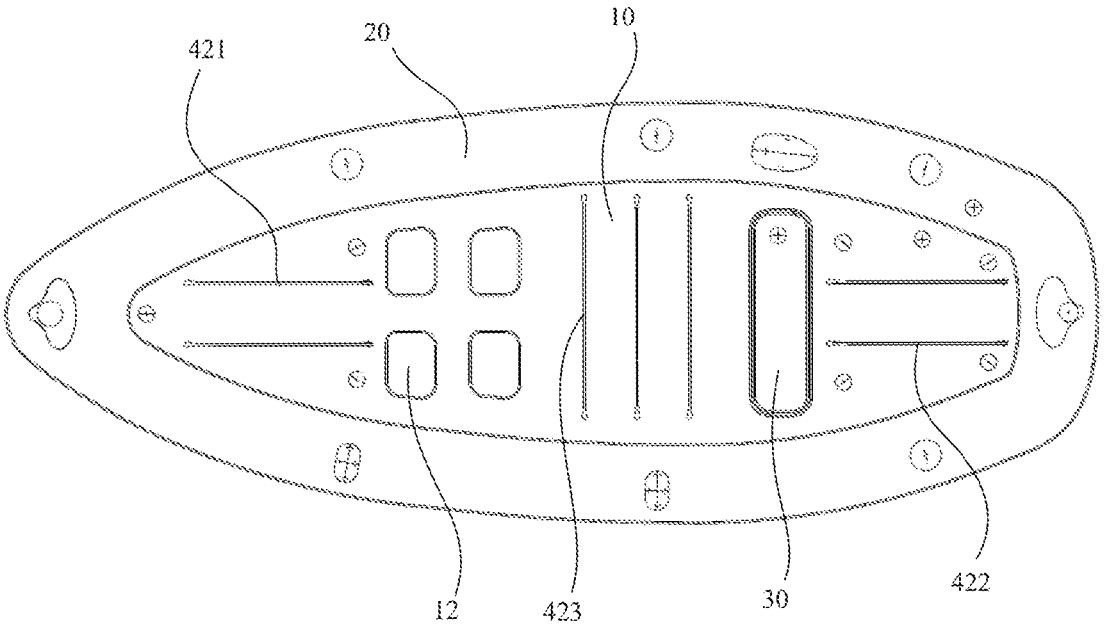
FIG. 5 is a top view of the inflatable boat.

According to an embodiment of the present invention, the top sheet 14 of the body 10 defines a backrest groove 13 for receiving a backrest 30 to provide leaning support for a user. The backrest groove 13 is spaced apart from the at least one footrest groove 12 and extends along the body 10 in a widthwise direction. The plurality of tensioning strips includes a plurality of fourth tensioning strips 44 located between the second set of first tensioning strips 422 and the plurality of second tensioning strips 423. The plurality of fourth tensioning strips 44 extends between the top sheet 14 and the bottom sheet 15 to define the backrest groove 13. In other words, the backrest groove 13 is defined by the plurality of fourth tensioning strips 44. According to an embodiment of the present invention, the backrest 30 is an inflatable backrest. As best illustrated in FIGS. 3 and 4, the backrest 30 comprises a first backrest sheet 32, a second backrest sheet 33, and a surrounding sheet 34. The surrounding sheet 34 couples to the first backrest sheet 32 to the second backrest sheet 33 to define a backrest chamber that can be inflated or deflated via a backrest gas valve 31. According to an embodiment of the present invention, a plurality of backrest tensioning strips 35, spaced apart from one another, extends between the first backrest sheet 32 and the second backrest sheet 33 to retain and support the backrest 30 in a predetermined shape.

It should be appreciated that the backrest 30 can be fixedly or detachably coupled to the backrest groove 13 of the body 10. According to an embodiment of the present invention, the backrest 30 can be fixedly coupled to the backrest groove 13 via welding, hot melting connection or bonding. According to an embodiment of the present invention, the backrest 30 can be detachably coupled to the backrest groove 13 by a snap-fitting structure. For example, a buckle or hook can be arranged in the backrest groove 13, and a mating hook or buckle can be arranged on the backrest 30, thereby establishing a detachable connection between the backrest 30 and the backrest groove 13.

Referring back to FIG. 1, according to an embodiment of the present invention, the inflatable boat 1 includes at least one accessory arranged on the body 10 and/or the tube 20. It should be appreciated that the at least one accessory can be arranged on the body 10 and/or the tube 20, including but not limited to a fixing rope 51, a handle 52, a paddle ring (not shown), or a paddle stand 53. The fixing rope 51 can be arranged on the top sheet 14 of the body 10 adjacent to the bow. Another fixing rope 51 can be arranged on the top sheet 14 of the body 10 adjacent to the stern for fixing a waterproof bag or other articles. The handle 52 can be arranged on the top sheet 14 of the body 10 for allowing a user to hold and lift the inflatable boat 1. The paddle rings or paddle stands 53 are symmetrically arranged on lateral sides of the tube 20 to provide support to paddles and store the paddles when the paddles are not in use. As best shown in FIG. 2, the body 10 includes at least one spoiler 54 located on the bottom surface of the body 10.

It should be understood that the body 10, the tube 20, the backrest 30, and the plurality of tensioning strips may be made of at least one of a PVC (polyvinyl chloride) film, a PU (polyurethane) film, laminated PVC mesh materials or laminated PU mesh materials. The various components and features described herein may be made of multiple materials, including but not limited to polymers, rubber, foam, metal, and coated fabrics (e.g., nylon, polyester, cotton or non-woven fabrics) and other suitable materials or combinations thereof well known to those skilled in the art.

It should be understood that the embodiments shown in FIGS. 1 to 5 show relative shapes, dimensions and arrangements of various components of the inflatable boat according to the present invention, which are merely illustrative but not restrictive, and other shapes, dimensions and arrangements may be employed without departing from the spirit and scope of the present invention.

The technical content and features of the present invention are disclosed herein, but it would be understood by those skilled in the art that one may make various variations and improvements to the concepts disclosed herein under the inventive idea of the present invention, and all the variations and improvements would fall into the scope of the present invention. The descriptions of the embodiments herein are illustrative and not restrictive, and therefore, the scope of the present invention is defined by the claims.

What is claimed is:

1. An inflatable boat, comprising:

a body comprising a top body sheet and a bottom body sheet;

a tube comprising a top tube sheet and a bottom tube sheet; and a tensioning member comprising a top edge coupled to the top body sheet and the top tube sheet and a bottom edge coupled to the bottom body sheet and the bottom tube sheet, such that a boat body chamber is defined by the tensioning member, the top body sheet and the bottom body sheet, and a boat tube chamber is defined by the tensioning member, the top tube sheet and the bottom tube sheet.

2. The inflatable boat according to claim 1, wherein the tube and the tensioning member each extend annularly about the body.

3. The inflatable boat according to claim 1, wherein the boat body chamber is fluidly separate from the boat tube chamber.

4. The inflatable boat according to claim 1, wherein the body further comprises a plurality of tensioning strips, each of the plurality of tensioning strips coupled to the top body sheet and the bottom body sheet.

5. The inflatable boat according to claim 4, wherein the plurality of tensioning strips comprises a first set of first tensioning strips located adjacent to a bow of the inflatable boat and a second set of first tensioning strips located adjacent to a stern of the inflatable boat.

6. The inflatable boat according to claim 5, wherein the plurality of tensioning strips further comprises a plurality of second tensioning strips located between the first set of first tensioning strips and the second set of first tensioning strips.

7. The inflatable boat according to claim 6, wherein:

each of the first set of first tensioning strips and each of the second set of first tensioning strips extends in a lengthwise direction within the body; and each of the plurality of second tensioning strips extends in a widthwise direction within the body.

8. The inflatable boat according to claim 6, wherein the body defines at least one footrest groove formed therein.

9. The inflatable boat according to claim 8, wherein the plurality of tensioning strips further comprises a plurality of third tensioning strips located between the first set of first tensioning strips and the plurality of second tensioning strips, each of the plurality of third tensioning strips extending between the top body sheet and the bottom body sheet.

10. The inflatable boat according to claim 9, wherein the body further defines a backrest groove formed therein, the backrest groove spaced apart from the at least one footrest groove and extending along the inflatable boat in the widthwise direction.

11. The inflatable boat according to claim 10, wherein the plurality of tensioning strips further comprises a plurality of fourth tensioning strips located between the second set of first tensioning strips and the plurality of second tensioning strips, the plurality of fourth tensioning strips extending between the top body sheet and the bottom body sheet.

12. The inflatable boat according to claim 11, further comprising:

a backrest located in the backrest groove, the backrest extending outwardly from the backrest groove.

13. The inflatable boat according to claim 12, wherein the backrest is detachably coupled to the body.

14. The inflatable boat according to claim 12, wherein the backrest is fixedly coupled to the body via at least one of welding, melting, and bonding.

15. The inflatable boat according to claim 12, wherein the backrest is inflatable and comprises: a first backrest sheet, a second backrest sheet, and a surrounding sheet, the surrounding sheet coupled to the first backrest sheet and the second backrest sheet, thereby defining a backrest chamber; and a plurality of backrest tensioning strips, spaced apart from one another and extending between the first backrest sheet and the second backrest sheet.

16. The inflatable boat according to claim 1, further comprising at least one of a fixing rope, a handle, a paddle ring, and a paddle stand.

17. The inflatable boat according to claim 1, further comprising at least one spoiler coupled to the bottom body sheet and extending outwardly from the bottom body sheet.

* * * * *